US007784244B2

(12) United States Patent
Siegel

(10) Patent No.: US 7,784,244 B2
(45) Date of Patent: Aug. 31, 2010

(54) HIGH SPEED AUTOMATED FILLING OF SOLID PHARMACEUTICAL PRODUCT PACKAGING VIA A CONVEYOR SYSTEM

(75) Inventor: Todd Siegel, St. Petersburg, FL (US)

(73) Assignee: MTS Medication Technologies, Inc., St. Petersburg, FL (US)

( * ) Notice: Subject to any disclaimer, the term of this patent is extended or adjusted under 35 U.S.C. 154(b) by 0 days.

(21) Appl. No.: 11/838,106

(22) Filed: Aug. 13, 2007

(65) Prior Publication Data

US 2009/0044489 A1 Feb. 19, 2009

(51) Int. Cl.
*B65B 5/04* (2006.01)

(52) U.S. Cl. ..... 53/246; 53/238; 53/475; 53/560; 53/151

(58) Field of Classification Search ..... 53/246, 53/238, 281, 475, 471, 287, 240, 560, 155, 53/154, 151
See application file for complete search history.

(56) References Cited

U.S. PATENT DOCUMENTS 4,065,000 A * 12/1977 Murton ..... 414/675
4,101,284 A * 7/1978 Difiglio et al. ..... 422/100
4,233,799 A * 11/1980 Caille ..... 53/154
4,834,264 A * 5/1989 Siegel et al. ..... 221/200
6,023,916 A * 2/2000 Bouthiette ..... 53/471
6,318,051 B1 * 11/2001 Preiss ..... 53/493
7,185,476 B1 * 3/2007 Siegel et al. ..... 53/443
7,334,379 B1 * 2/2008 Siegel et al. ..... 53/55
2002/0153056 A1 * 10/2002 Siegel et al. ..... 141/247
2007/0125046 A1 * 6/2007 Siegel et al. ..... 53/471

* cited by examiner

*Primary Examiner*—Sameh H. Tawfik
(74) *Attorney, Agent, or Firm*—Robert J. Depke; Rockey, Depke & Lyons, LLC

(57) ABSTRACT

Systems and methods for providing individualized solid pharmaceutical product packaging solutions preferably utilize a plurality of filling stations preferably arranged proximate to a conveyor system. Each of the filling stations may be embodied as a version of a conventional flood fill type mechanism wherein a hopper is used to store a large number of a single type of solid pharmaceutical products. The filling stations preferably incorporate transition blocks and/or row or column transfer gates.

5 Claims, 10 Drawing Sheets

HIGH SPEED AUTOMATED FILLING OF SOLID PHARMACEUTICAL PRODUCT PACKAGING VIA A CONVEYOR SYSTEM

BACKGROUND OF THE INVENTION

1. Field of the Invention

The present invention relates generally to the field of automated solid pharmaceutical packaging systems. More specifically, the present invention is directed to a unique arrangement of automated solid pharmaceutical packaging machinery which advantageously achieves extremely high throughput for automatically filling solid pharmaceutical product packaging. The systems and methods of the present invention are particularly suitable for filling of individualized solid pharmaceutical product packages which may be used to provide a plurality of prescription medications for an individual.

2. Description of the Related Art

A wide variety of solid pharmaceutical product packaging machinery is currently available. Significantly, however, existing arrangements of solid pharmaceutical packaging machinery have issues relating to the potential for cross-contamination of the machinery due to the fact that multiple different medications may be processed via a single structure and therefore particles or portions from one medication may inadvertently and undesirably contaminate the processing machinery which is used in processing another medication. Furthermore, there is an ever increasing demand for individualized solid pharmaceutical product packaging solutions and accordingly higher throughput and capacity is desired for existing machinery.

The number of patients currently living in managed-care environments is growing dramatically and the rate of growth is expected to increase dramatically in the coming years. Yet another factor related to the increased demand for individualized solid pharmaceutical product packaging solutions is due to the fact that ever-increasing numbers of an aging population are relying upon greater numbers of medications which must be taken daily or in some cases several times in one day. It may be difficult for an individual to meet the dosing requirements for a number of medications in a given day when the medications are provided in bulk containers. Members of an aging population can become confused and may forget whether they have already taken a particular medication. Customized packaging solutions are currently available which provide the consumers with time and date dosing indications but it is necessary for the managed care facility to provide customized packaging of multiple solid pharmaceuticals depending upon the prescriptions required for an individual.

Accordingly, in light of these considerations, it is apparent that there is an ever increasing demand for individualized solid pharmaceutical product packaging solutions. It is also desirable to provide higher throughput in order to satisfy the greater demand while minimizing the potential for cross-contamination.

The applicants of the instant invention have discovered new and improved arrangements and highly efficient automated solid pharmaceutical product packaging solutions which are capable of attaining tremendous throughput for packaging individualized groupings of solid pharmaceutical products while also minimizing the potential for cross-contamination of the system.

SUMMARY OF THE INVENTION

The present invention is directed to new and improved solid pharmaceutical product packaging solutions which provide a dramatic increase in the overall throughput for the solid pharmaceutical product packaging machine while also minimizing the potential for cross-contamination of the processing machinery arising out of the processing of multiple types of solid pharmaceutical products. In accordance with a preferred exemplary embodiment of the present invention, the systems and methods for providing individualized solid pharmaceutical product packaging solutions preferably utilize a plurality of filling stations preferably arranged proximate to a conveyor system. Those skilled in the art will appreciate that the conveyor system is not necessary, however, and the unique filling station of the present invention may be utilized independently. Each of the filling stations may be embodied as a version of a conventional flood fill type mechanism wherein a hopper is used to store a large number of a single type of solid pharmaceutical products.

In accordance with a preferred exemplary embodiment of present invention, each of the filling stations incorporates at least one package template or temporary storage portion or shuttle member having a plurality of product package cavity locations corresponding to each of the product package cavities that are to be filled by the system. The hopper is used as a source of medications for filling the product package cavities of the product package template or shuttle member. A sweeper mechanism or mechanical vibration may be used to insure that each of the template cavities or cavities of the shuttle member are filled by the solid pharmaceuticals contained within the hopper.

The temporary storage cavity arrangement of the template or shuttle is used to temporarily secure solid pharmaceutical products that are received from the hopper of the filling station. In accordance with a preferred exemplary embodiment, as soon as the initial product package template or shuttle is filled by the system, a temporary cover plate is shifted so that openings in the temporary cover do not correspond with locations of openings in the bottom of the hopper and therefore no additional medications from the hopper will pass through openings in the bottom thereof when the temporary storage template or shuttle member is withdrawn from its initial position directly beneath the hopper.

After the temporary storage cavities are removed their initial location beneath the hopper, the product package template or shuttle member is preferably positioned directly beneath a digital camera or other imaging device for automated vision verification that all desired cavities have been filled by the appropriate medications.

In accordance with a preferred exemplary embodiment, after all of the desired pills have been verified to be present by the imaging system, the shuttle or product package template is thereafter preferably moved to a location directly above a conveyor system which preferably transfers either an additional product package template or solid pharmaceutical product package having an array of cavities. Those skilled in the art will also appreciate that the imaging verification may alternately take place directly over the location of the conveyor system.

In accordance with a preferred exemplary embodiment of the present invention, a transition bock may be utilized to alter the spacing and/or arrangement of the solid pharmaceuticals contained in the array of cavities of the shuttle or initial product package template so that they may be transferred to a further product package template or array having different physical relationships for cavities in its array. More specifically, the transition block may simply alter the cavity array spacing from a first spacing for the initial shuttle or temporary storage package cavity to a further spacing for an alternate arrangement.

The conveyor system is then utilized to transfer either a solid pharmaceutical product package portion into which a plurality of solid pharmaceuticals have been positioned via the first filling station to a location beneath one or more additional filling stations so that a desired number of different medications may be provided by the system. In accordance with a preferred exemplary embodiment of the system, a microprocessor controller is programmed to ensure that each of the necessary medications for every single one of one or more prescriptions for a given patient are incorporated into a single customized solid pharmaceutical product package. This is accomplished by ensuring that the package or template associated with a given patient is transferred to locations beneath each filling station corresponding to all of the medications required by the patient's one or more prescriptions.

In accordance with a preferred exemplary embodiment of the present invention, the transfer of the medications from the initial temporary storage product package template or shuttle is accomplished by a sliding gate. A sliding gate reveals openings so that the desired members from the array are transferred from the shuttle or product package template preferably through the transition block into the further temper storage member or package cavity. The sliding gate may be embodied as a single member having a size corresponding to the entire array of cavities for the product package template or shuttle member. Alternatively, a plurality of gates may be provided which in accordance with a preferred exemplary embodiment are arranged corresponding to either the rows or columns of the array of solid pharmaceutical products found in the initial temporary storage member or product package template.

Advantageously, by providing gates corresponding to the rows or columns of the initial temporary storage template or shuttle, the system is able to selectively transfer a limited number of medications which may correspond to the daily doses for an entire week required for a given patient. The systems of the prior art were only capable of transferring an entire arrays worth of the solid pharmaceutical products and there was no mechanism for selectively transferring only medications for a given row or column of the array.

In accordance with the preferred exemplary embodiment of the present invention, after all of the necessary solid pharmaceuticals have been deposited into the array of cavities for a temporary storage product package template or shuttle member or the actual package cavities, the system then seals the solid pharmaceuticals in the package cavities and preferably prints information identifying the patient and prescriptions on the package.

DETAILED DESCRIPTION OF THE PRESENTLY PREFERRED EMBODIMENTS

Figure 1:
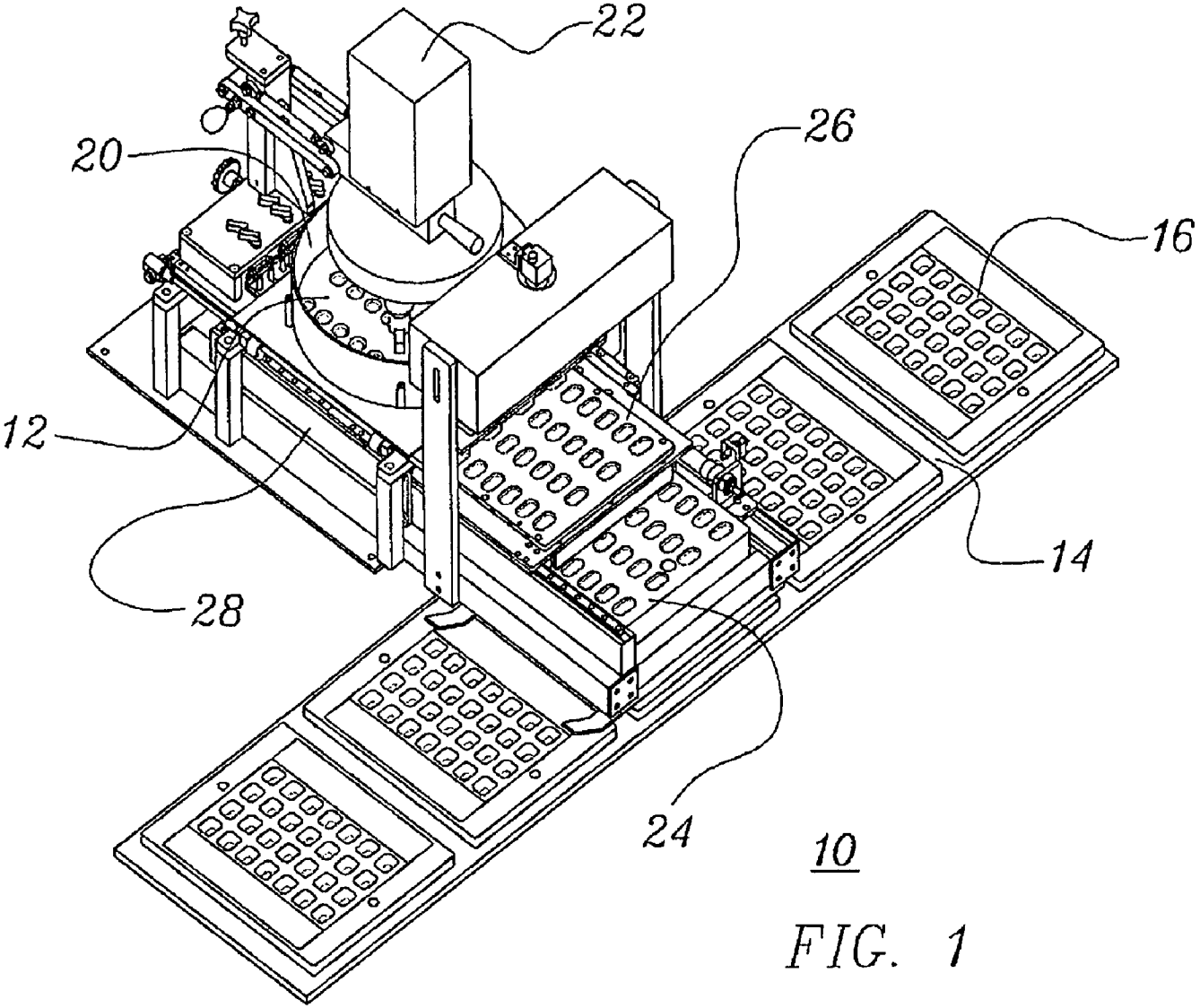
FIG. 1 illustrates a first exemplary embodiment of a preferred arrangement for the overall system of the present invention.

FIG. 1 illustrates a first preferred exemplary embodiment of the system which is shown generally at 10. FIG. 1 specifically illustrates the overall arrangement of the various portions of the system. In this illustration, only one filling station 12 is illustrated so that the details thereof may be more apparent. In this preferred exemplary embodiment of system, the filling station 12 extends over a portion of the conveyor system 14. The conveyor system 14 preferably transfers product package templates 16 or the cavity portion of a solid pharmaceutical product package having an array of cavities.

Each filling station 12 is preferably comprised of a hopper 20 which contains a bulk supply of a single type of solid pharmaceutical products that are to be deposited in a solid pharmaceutical product package. A sweeping mechanism 22 or agitator is utilized to ensure that solid pharmaceutical products contained within the hopper 20 are transferred into the cavities of a shuttle member or temporary storage product package template. FIG. 1 illustrates an arrangement of the overall device wherein the shuttle member 24 having a plurality of temporary storage cavities 26 is partially extended from an original position beneath the hopper 20. A sliding gate is initially positioned between the bulk solid pharmaceutical product contained within the hopper 20 and the shuttle member 24. The sliding gate is provided in order to enable the selective transfer of solid pharmaceutical products from a hopper into the cavities 26 of the shuttle member 24 or product package template.

After the cavities 26 of the shuttle member 24 or the product package template have been filled, the initial gate is placed in the closed position to cover openings in the bottom of the hopper 20 which would otherwise expose cavities 26. This enables the cavities 26 to be filled with the desired solid pharmaceutical products and also prevents solid pharmaceuticals from inadvertently escaping from the hopper 20. The shuttle member 24 having solid pharmaceutical products contained within its cavities 26 is then maneuvered to a position beneath a camera member 28. After the temporary storage cavities are removed from their initial location beneath the hopper, the product package template or shuttle member is preferably positioned directly beneath a digital camera or other imaging device for automated vision verification that all desired cavities have been filled by the appropriate medications. This stage of the process is illustrated in FIG. 1 In accordance with a preferred exemplary embodiment, after all of the desired pills have been verified to be present by the imaging system, the shuttle or product package template is thereafter preferably moved to a location directly above a conveyor system which preferably transfers the solid pharmaceutical products from the initial shuttle or product package template to either an additional product package template 14 or solid pharmaceutical product package having an array of cavities. Those skilled in the art will also appreciate that the imaging verification may alternately take place directly over the location of the conveyor system.

Figure 2A:
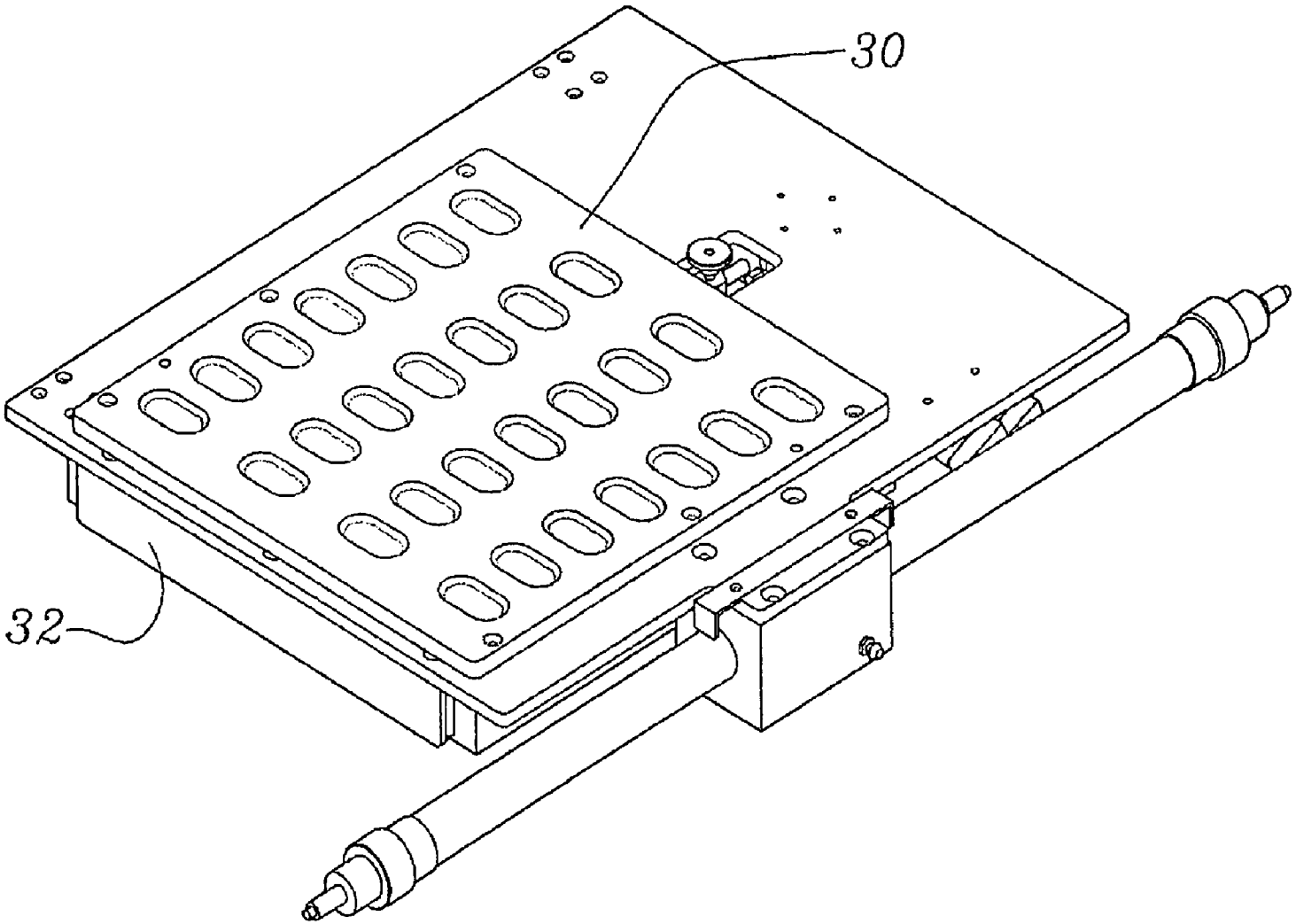
FIG. 2A illustrates a first exemplary embodiment of a preferred arrangement providing details of the shuttle tray with a single gate.
Figure 2B:
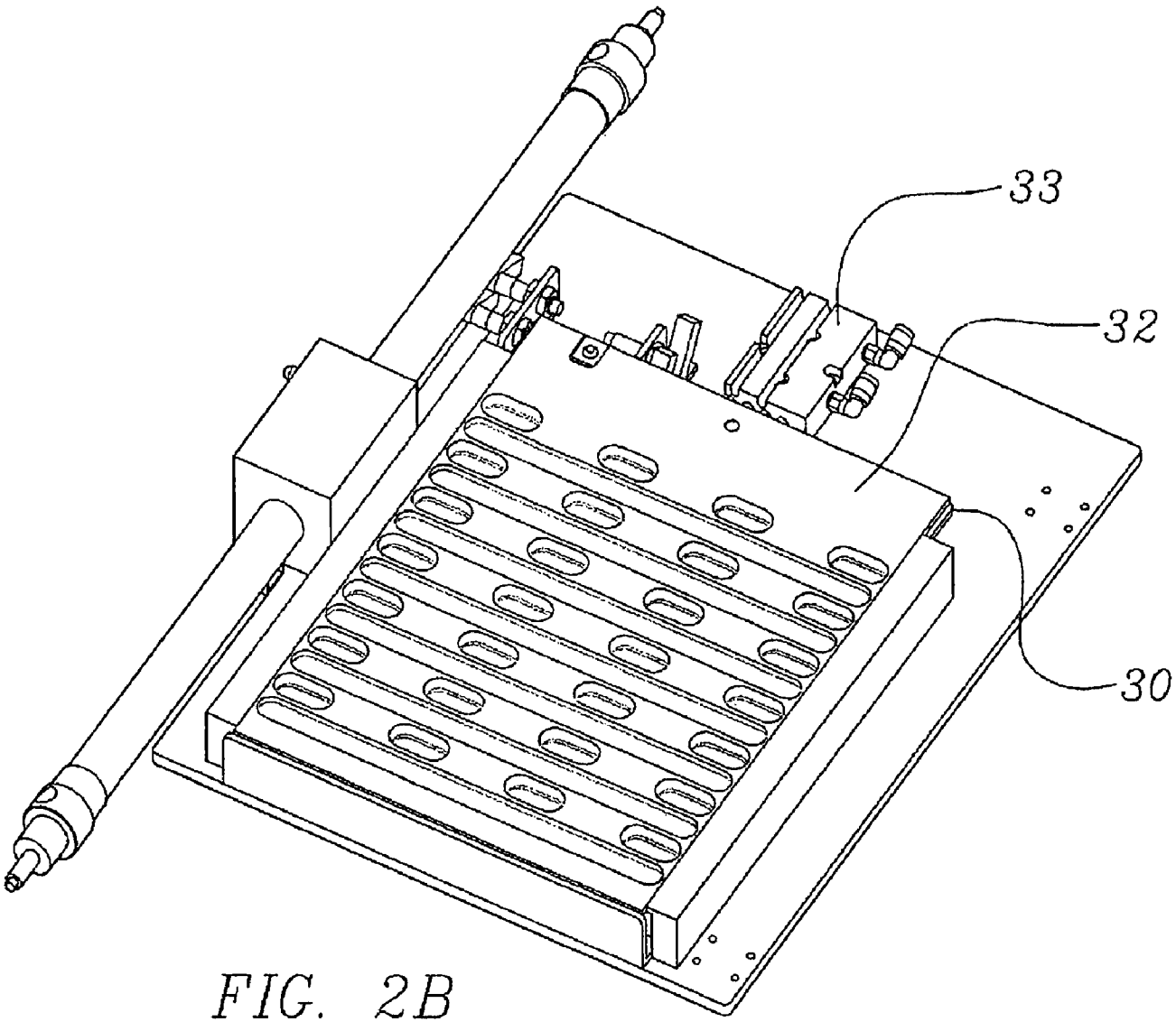
FIG. 2B illustrates a first exemplary embodiment of a preferred arrangement providing details of the bottom of the shuttle tray with a single gate.
Figure 3A:
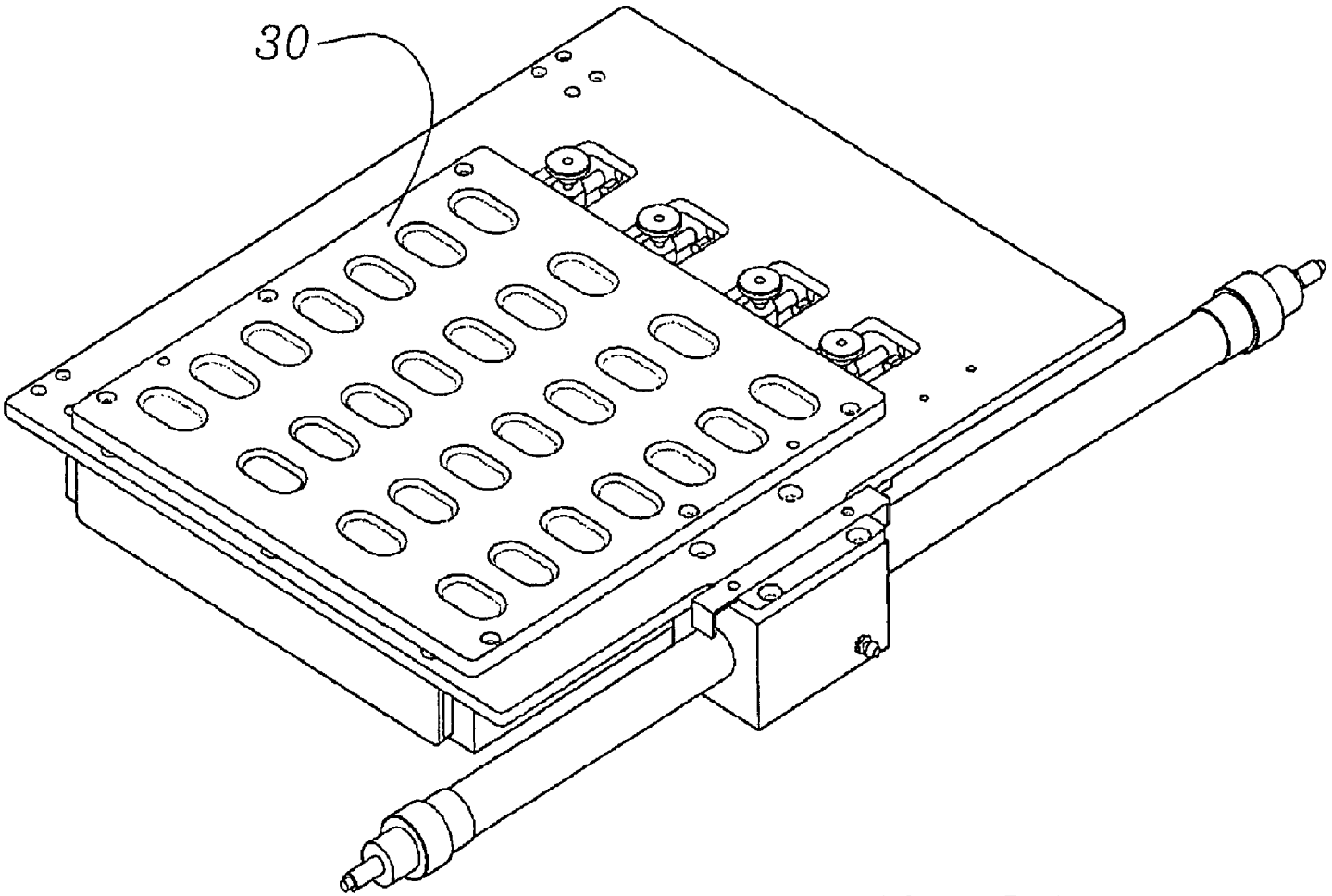
FIG. 3A illustrates a first exemplary embodiment of a preferred arrangement providing details of the shuttle tray with multiple gates.
Figure 3B:
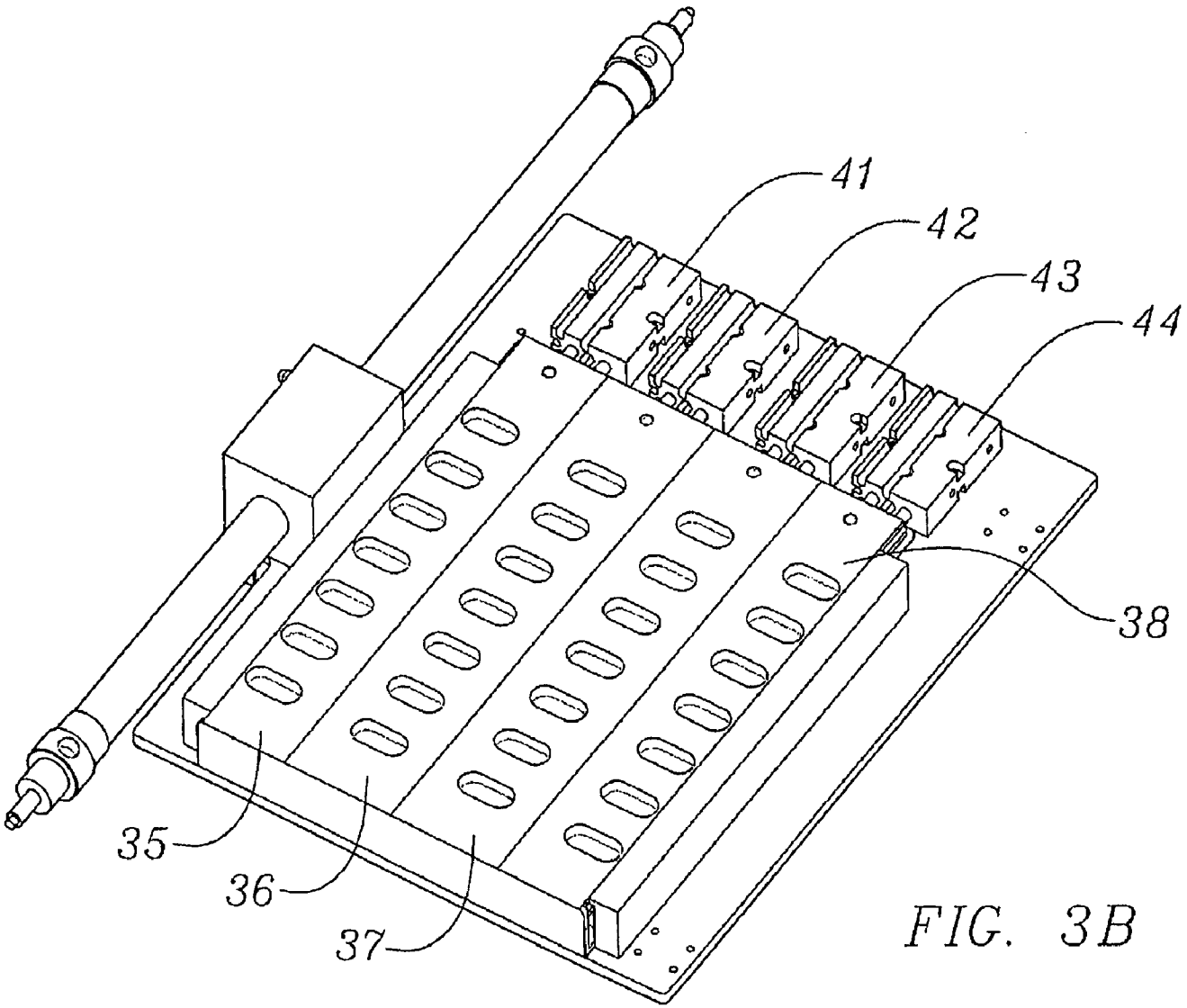
FIG. 3B illustrates a first exemplary embodiment of a preferred arrangement providing details of the bottom of the shuttle tray with multiple gates.

FIG. 2A illustrates a top view of the shuttle tray 30 having a single gate 32 which is a unitary body that slides from an open position wherein the cavities of the shuttle are exposed to a closed position wherein the cavities are secured by the gate thereby preventing the transfer of solid pharmaceutical products contained within the shuttle tray 30. FIG. 2B is a bottom view of the shuttle tray which illustrates the sliding gate 32 and its corresponding actuator 33. FIG. 3A illustrates a top view of the shuttle tray 30 having a multiple gate structure which are plurality of independently moving bodies that slide from an open position wherein the cavities of the shuttle are exposed to a closed position wherein the cavities are secured by the gate thereby preventing the transfer of solid pharmaceutical products contained within the shuttle tray 30. FIG. 3B is a bottom view of the shuttle tray 30 which illustrates the multiple sliding gate structure wherein individual independent sliding gates 35, 36, 37, and 38 and corresponding independent gate actuators 41, 42, 43, 44 are provided to independently open and close the shuttle cavities secured by the corresponding linear gate members.

When a plurality of gates are provided in accordance with a preferred exemplary embodiment, they are preferably arranged corresponding to either the rows or columns of the array of solid pharmaceutical products found in the initial temporary storage member or product package template and is corresponding rows or columns of the package to be filled.

Advantageously, by providing independent gates corresponding to the rows or columns of the initial temporary storage template or shuttle and the package to be filled, the system is able to selectively transfer a limited number of medications which may correspond to the daily doses for an entire week required for a given patient. The systems of the prior art were only capable of transferring an entire arrays worth of the solid pharmaceutical products and there was no mechanism for selectively transferring only medications for a given row or column of the array.

Figure 4A:
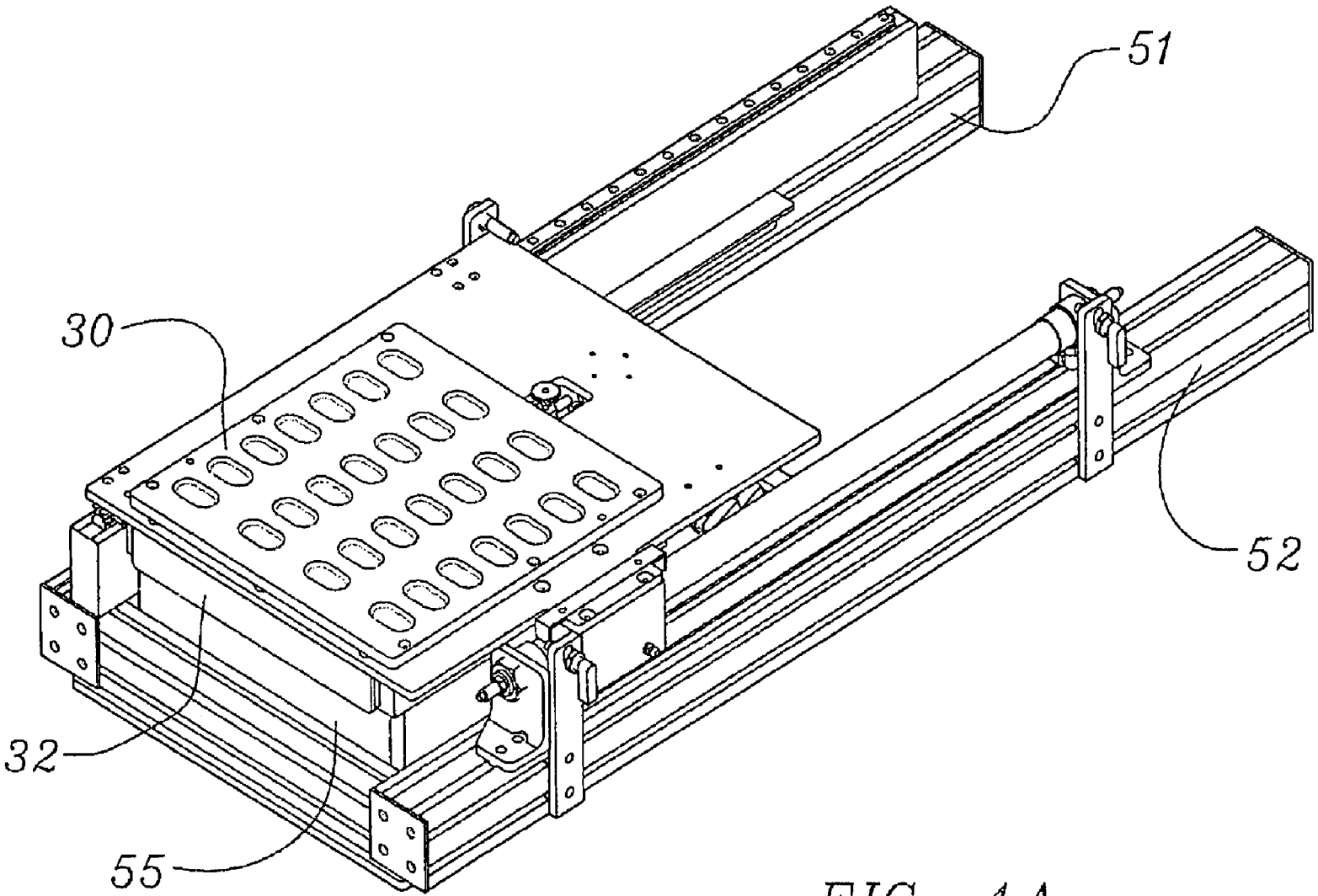
FIG. 4A illustrates details of a first exemplary embodiment of the shuttle tray or package template positioned over a transition bock.

FIG. 4A is a detailed illustration which shows the shuttle tray 30 in an extended position along with its corresponding gate 32 which in this exemplary embodiment is a single gate structure. The shuttle tray 30 is transferred with its corresponding gate 32 along guide members 51, 52. In the preferred exemplary embodiment, pneumatic drives are provided to effect motion of the shuttle tray 30. Those skilled in the art will appreciate that alternative drives may be utilized such as, for example, electric drives or motor drives and/or solenoid. It may be preferable to you solenoid for temporary displacement of the gate members but the particular selection for the drive mechanism is not critical.

FIG. 4A also illustrates the shuttle tray 31 it is positioned directly above transition block 55. A transition bock is a mechanical structure which may be utilized to alter the spacing and/or arrangement of the solid pharmaceuticals contained in the array of cavities of the shuttle or initial product package template so that they may be transferred to a further product package template or array having different physical relationships for cavities in its array. More specifically, the transition block 55 may simply alter the cavity array spacing from a first spacing for the initial shuttle or temporary storage package cavity to a further spacing for an alternate arrangement.

Figure 4B:
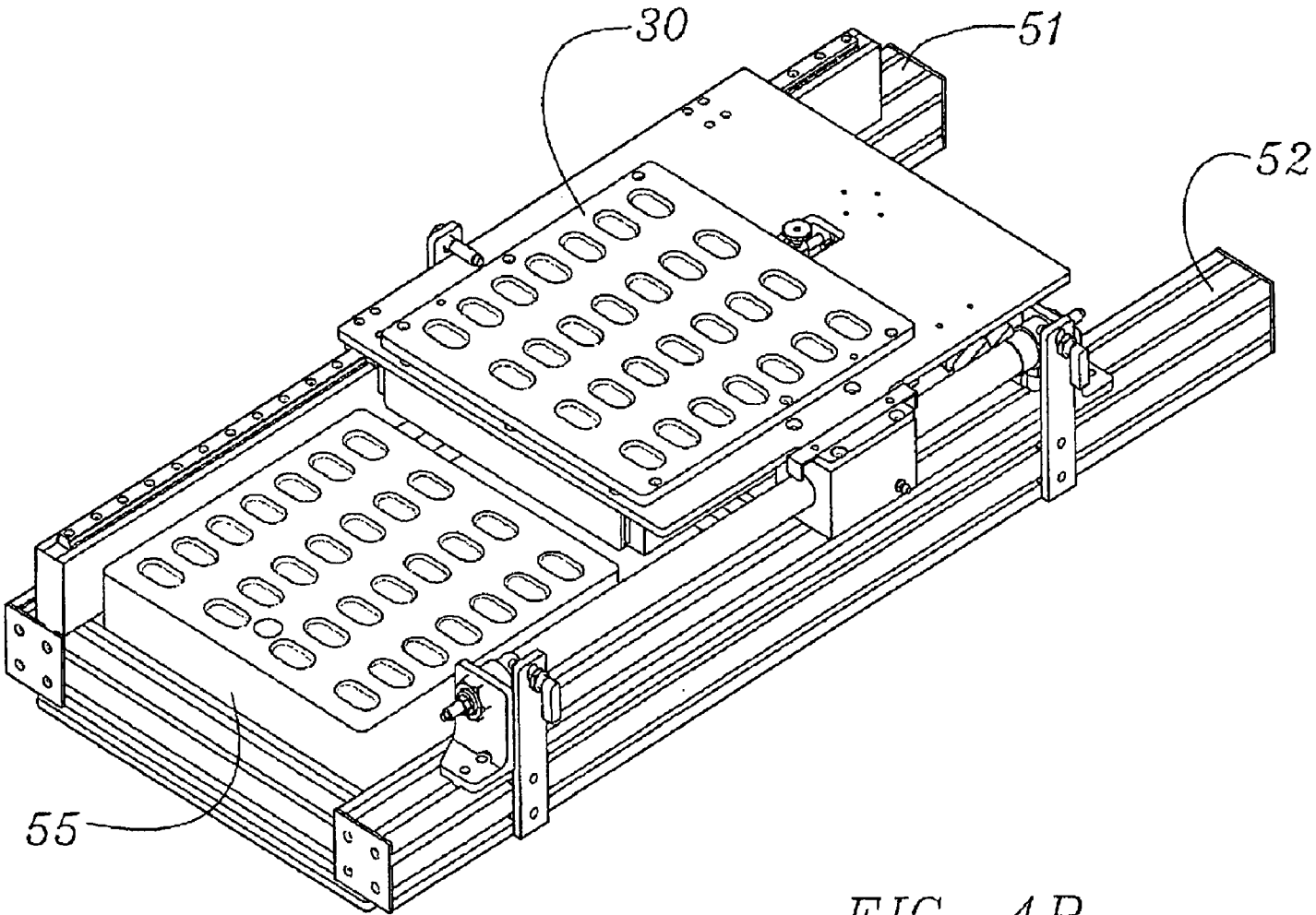
FIG. 4B illustrates details of a first exemplary embodiment of the shuttle tray or package template positioned adjacent a transition bock.

By using a transition block 55, is possible to conveniently fill product packages having various cavity arrangements without having to change much of the physical structures associated with individual filling stations. The transition block 55 is a convenient mechanism for altering any differences in the physical arrangements for the array members which may exist between an actual product package cavity and the shuttle tray or initial temporary product package template. Accordingly, the systems and methods utilizing the structure are much more flexible and simple to use. FIG. 4B illustrates an alternate arrangement wherein the shuttle tray 30 is located adjacent to the transition block 55.

Figure 5A:
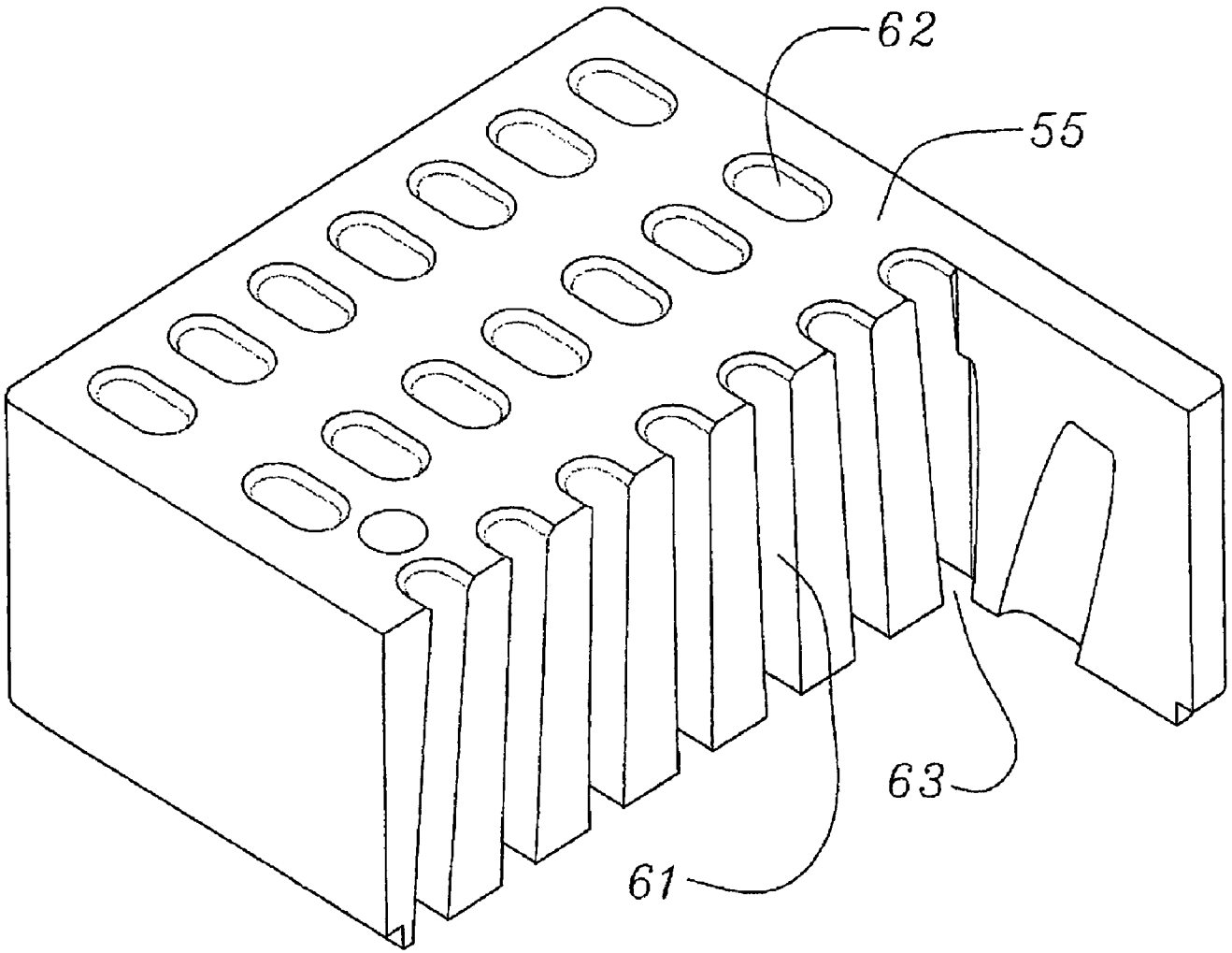
FIG. 5A illustrates cutaway details of a first exemplary embodiment of the transition block.
Figure 5B:
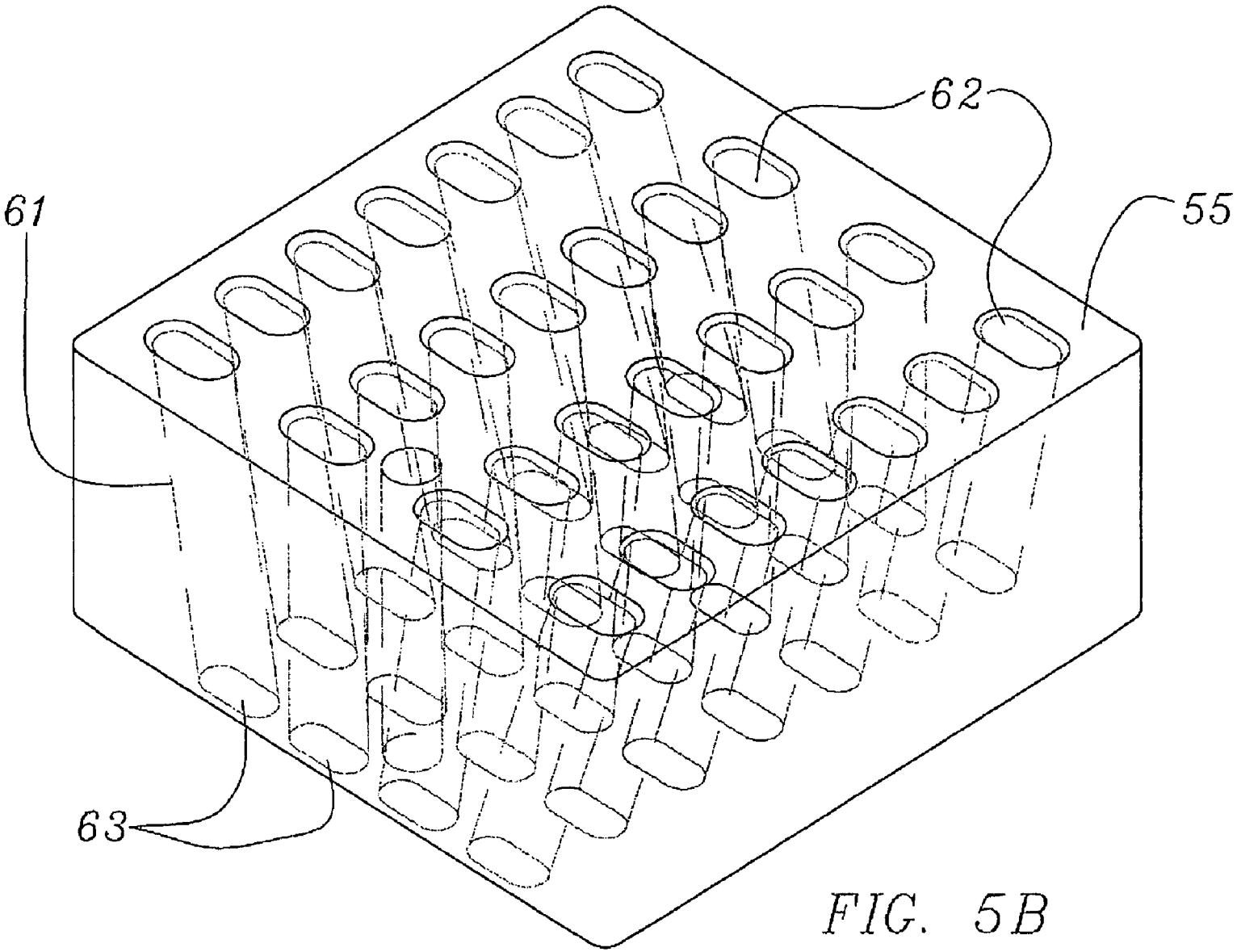
FIG. 5B is a semitransparent perspective view illustrating of a first exemplary embodiment of the transition block.

FIG. 5A is a cutaway illustration which shows the transition block and its structures for effecting any necessary transition in the arrangement of the cavities. Those skilled in the art will appreciate that by providing internal transition channels 61 between upper openings 62 and lower openings 63 which connect corresponding upper openings 62 with lower openings 63, a wide variety of differences in the arrangement of the cavity arrays between an upper arrangement and a lower arrangement may be accommodated. FIG. 5B is a semi transparent illustration of the transition block 55 illustrated in FIG. 5A. FIG. 5B clearly demonstrates how different arrangements of the cavities in any upper array may be matched to a lower array having a different arrangement of the cavities.

Figure 6:
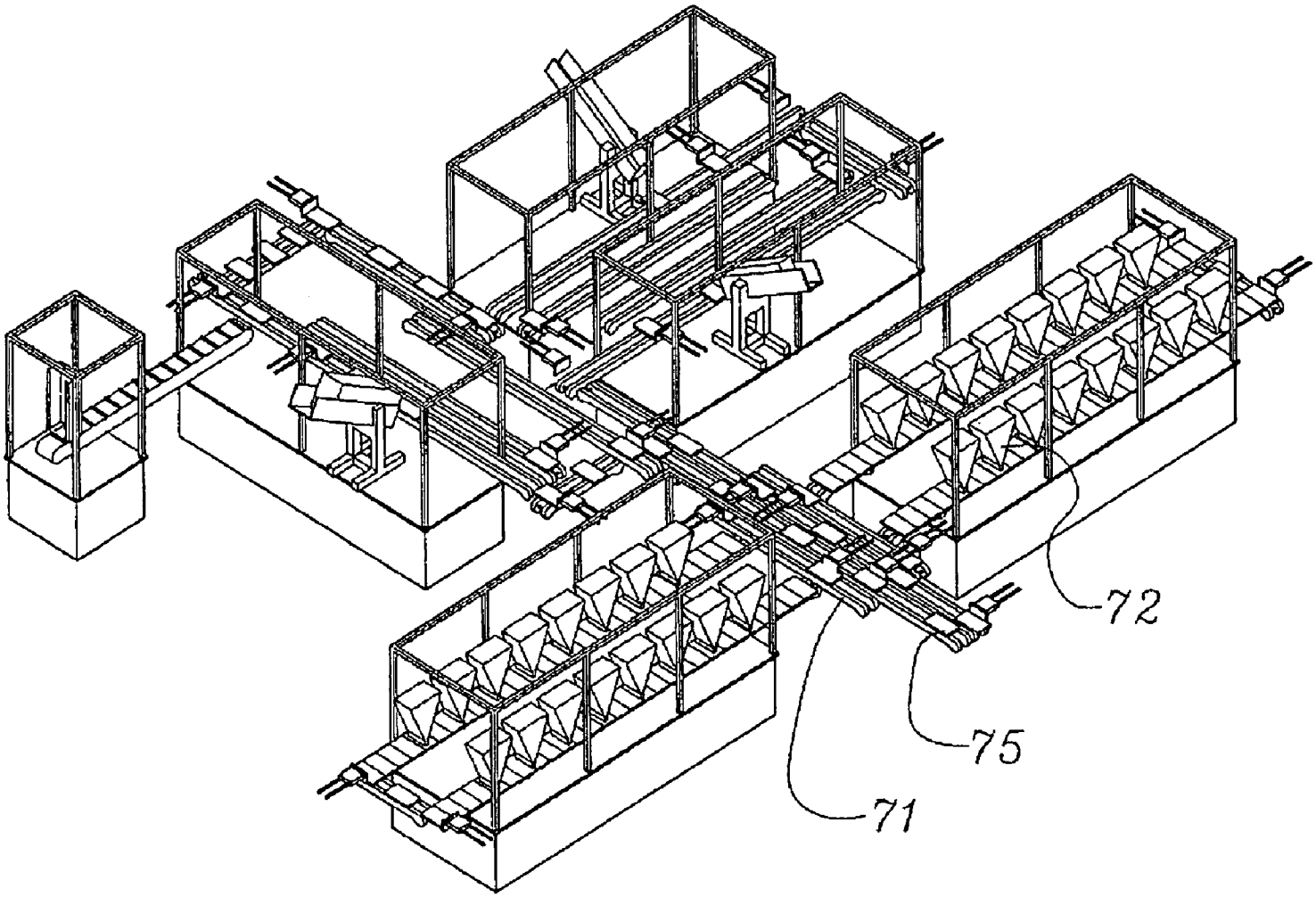
FIG. 6 illustrates a first exemplary embodiment of the overall conveyor system and the arrangement of filling stations along the conveyor system.

FIG. 6 illustrates a conveyor system 71 for use in conjunction with the filling stations which are example five by triangular blocks 72 in the illustration of FIG. 6. As shown in the illustration of FIG. 6, the filling stations may be used to transfer medications from the individual filling station 72 into independently transferable solid pharmaceutical product package templates 75 or conveyed structures which secure at least a portion of a product package having an array of cavities arranged therein. Those skilled in the art will appreciate that the independent motion of the product package templates 75 or bodies holding at least portions of product package cavities which include arrays of the cavities can be used to quickly and conveniently fill a plurality of prescriptions for a given patient into a blister card package for a given patient having a plurality of different prescriptions. This is accomplished by programming the system to selectively convey independently movable product package templates or bodies holding at least portions of product package cavities beneath filling stations for each of the medications required by a patient's prescriptions.

As noted above, transition blocks may be provided at each of the filling stations as necessary to provide the desired flexibility to handle virtually any solid pharmaceutical product package arrangement. Those skilled in the art will appreciate that various adjustments can be made to the systems and methods of the present invention described herein but which will nonetheless fall within the spirit and scope of the appended claims.

I claim:

1. A system for filling an array of product package cavities with solid pharmaceuticals comprising:

a first filling station for selectively filling at least one row or column of cavities of a first product package template shuttle with a solid pharmaceutical product;

automatically positioning the first product package template shuttle above a further product package template shuttle or a product package portion transferred by a conveying system;

automatically selectively releasing the solid pharmaceutical products from at least one row or column of cavities of the first product package template shuttle into corresponding cavities of the further product package template or product package portion that is transferred by a conveying system; and further comprising selectively positioning a second and third package template shuttle beneath a corresponding second and third filling station under control of a microprocessor and selectively filling at least one row or column of cavities of the second and third product package template shuttles with a solid pharmaceutical product and thereafter automatically selectively releasing the solid pharmaceutical products from at least one row or column of cavities of the second and third product package template shuttles into corresponding cavities of the further product package template or product package portion that is transferred by a conveying system such that all required pharmaceutical into specified locations of a product package so that all medications designated by one or more prescriptions for a patient are deposited into specific product package cavities for the patient.

2. The system for filling an array of product package cavities according to claim 1, wherein the solid pharmaceuticals pass through a transition block which provides simultaneous transfer of a plurality of solid pharmaceuticals from a temporary storage member having a plurality of cavities arranged in an array having a first spacing between members of the array to an array of cavities arranged at a second spacing that is different from the first spacing.

3. The system for filling an array of product package cavities according to claim 2, wherein a separate gate corresponding to each row of cavities for a package template is provided beneath the transition block.

4. The system for filling an array of product package cavities according to claim 1, wherein a separate gate corresponding to each row of cavities for a package template is provided.

5. The system for filling an array of product package cavities according to claim 1, further comprising an imaging element for providing image information that is used to confirm whether a required solid pharmaceutical product is located in each specified location.

* * * * *